United States Patent [19]

LaSance

[11] Patent Number: 4,565,030

[45] Date of Patent: Jan. 21, 1986

[54] EMERGENCY EXIT SYSTEMS FOR REVOLVING DOORS

[75] Inventor: William A. LaSance, Altadena, Calif.

[73] Assignee: Dynametric, Inc., Pasadena, Calif.

[21] Appl. No.: 566,030

[22] Filed: Dec. 27, 1983

[51] Int. Cl.[4] ..... E05D 15/02

[52] U.S. Cl. ..... 49/44; 49/31; 49/141; 49/506

[58] Field of Search ..... 49/141, 44, 31, 506, 49/42

[56] References Cited

U.S. PATENT DOCUMENTS 3,782,035 1/1974 Lowe ..... 49/44
3,793,773 2/1974 Sheckells ..... 49/141 X
4,458,447 7/1984 Heise et al. ..... 49/44

*Primary Examiner*—Philip C. Kannan
*Attorney, Agent, or Firm*—Benoit Law Corporation

[57] ABSTRACT

An emergency exit is provided through a revolving door, having leaves angularly spaced from each other and rotatable in an enclosure in an operating condition, by automatically aligning all of these leaves parallel to a line of exit traffic through the enclosure. The revolving door leaves may be so aligned by first biasing the leaves toward each other, but maintaining the leaves angularly spaced by releasable retention against the bias exerted by such biasing, and by thereafter releasing such retention in response to an emergency condition and aligning the leaves automatically by force of the bias.

24 Claims, 9 Drawing Figures

EMERGENCY EXIT SYSTEMS FOR REVOLVING DOORS

BACKGROUND OF THE INVENTION

1. Field of the Invention

The subject invention relates to doors and to emergency exits, to revolving doors and, more specifically, to the provision of emergency exits through revolving doors.

2. Information Disclosure Statement

The following disclosure statement is made pursuant to the duty of disclosure imposed by law and formulated in 37 CFR 1.56(a). No representation is hereby made that information thus disclosed in fact constitutes prior art, inasmuch as 37 CFR 1.56(a) relies on a materiality concept which depends on uncertain and inevitably subjective elements of substantial likelihood and reasonableness and inasmuch as a growing attitude appears to require citation of material which might lead to a discovery of pertinent material though not necessarily being of itself pertinent. Also the following comments contain conclusions and observations which have only been drawn or become apparent after conception of the subject invention or which contrast the subject invention or its merits against the background of developments which may be subsequent in time or priority.

Revolving doors have been used for a long time as a convenient means for providing routine access to and egress from buildings, while preserving the desired inside temperature of the building against the cold in winter and the heat in summer and other seasonal fluctuations. Compared to a regular swinging or sliding door, revolving doors tend to be rather bulky, having a width on the order of their height. Also, traditional revolving doors tend to be unsafe in a panic, where people exiting a building during a fire or other emergency may work against each other on different leaves of a revolving door. In consequence, fire safety and other regulations usually require the provision of a swinging-type emergency exit adjacent to each revolving door. The inherent bulk of a revolving door is thus in practice aggravated by the need of a separate emergency exit, which further increases the needed width of a revolving door installation.

In recent years, proposals have arisen to construct leaves of revolving doors in a breakaway fashion, permitting panicked people or others trying to exit a building in an emergency, to fold leaves of a revolving door in the direction of their desired exit through the revolving door enclosure.

One problem with such proposals has been their need for an almost impossible compromise. On the one hand, the breakaway feature has to be such that people attempting to exit the building in an emergency could really break the revolving door leaves loose without undue resistance. On the other hand, care had to be taken that normal causes, such as the air pressure differential between the inside and outside of an air conditioned building, would not actuate the breakaway feature.

In practice, this compromise was difficult to reach, and there were many instances where revolving door leaves either broke loose during normal operation or, contrariwise, were difficult to align with the exit traffic in an emergency.

Some control over this situation was obtained with the aid of magnetic locks having one part, such as the wound armature, associated with a turnstyle, defining the mutual angular position of the revolving door leaves, and having the other part, such as a striker plate, associated with a revolving door leaf. In practice, two or more of the door leaves were equipped with magnetic locks which held the door leaves in their respective angular position during normal operation of the revolving door. In case of an emergency, such as manifested by the signal of a smoke detector, the magnetic locks were deenergized, whereby the door leaves became loose and could be moved into the direction of the main exit traffic by people leaving the building in an emergency.

This, however, left the door leaves in an uncertain position liable to confuse some people. The idea thus arose to provide a solenoid-actuated ratchet drive for stepping the loose door leaves to the direction of main exit traffic. This was, however, also not acceptable from a security point of view.

An overriding problem in this area is that fire officials and building safety people are very concerned about the heavy losses attributed to revolving doors in fire disasters going back for decades and including the terrible fire at the Coconut Grove night club in Boston, where close to 500 people perished some forty years ago, when the panicky crowd jammed the revolving doors in an attempt to escape the disaster. Accordingly, solutions and advances in the art of the highest order are required for a realization of any endeavor to provide for emergency exits through revolving doors.

SUMMARY OF THE INVENTION

It is a general object of this invention to overcome the disadvantages and to meet the needs expressed or implicit in the above disclosure statement or in other parts hereof.

It is a related object of this invention to provide improved revolving door systems.

It is also a related object of this invention to provide improved emergency exit systems for or through revolving doors.

It is a germane object of this invention to increase the safety of buildings equipped with revolving doors, against the effects of emergency conditions or panic situations.

Other objects of the invention will become apparent in the further course of this disclosure.

From a first aspect thereof, the subject invention resides in a method or apparatus for providing an emergency exit for people through a revolving door having leaves angularly spaced from each other in an operating condition and rotatable in an enclosure having opposed inside and outside openings relative to a building wall. The invention according to this aspect resides, more specifically, in the recognition that the aboved mentioned problems impeding development and acceptance of emergency exit revolving doors are solved by continuously imposing on the door leaves a bias tending to fold such leaves towards each other. In the normal operating condition of the revolving door, the rotatable leaves are retained angularly spaced from each other against the mentioned continuous bias. However, in an emergency condition, the angularly spaced leaves are released so that the mentioned continuously imposed bias folds the released leaves toward each other and provides the emergency exit through the openings of the rotating door enclosure.

The folding of the door leaves thus automatically effected with the aid of the continuously imposed bias may be compared to the kind of folding carried out by pages of a book, when such book is closed, except that a revolving door has, of course, considerably less leaves than the number of pages of a typical book.

In order to restore the revolving door to its normal operating condition, the folded leaves are restored to their angularly spaced positions after an emergency.

Even though the above mentioned bias is continuously imposed according to the currently discussed aspect of the invention, such bias, according to a preferred embodiment, is enabled to be overridden by people exiting the revolving door enclosure in an emergency. According to a further preferred embodiment of the subject invention, the mentioned bias is enabled to be overridden in either direction by people anxious to pass through the revolving door enclosure either way in a emergency.

Also, in order to prevent injury to people, a preferred embodiment of the subject invention imposes adjustable sweep speeds on the released door leaves.

From another aspect thereof, the subject invention resides in apparatus for providing an exit for people through a building wall, comprising, in combination, a revolving door having leaves angularly spaced from each other in an operating condition and rotatable in an enclosure having opposed inside and outside openings relative to the building wall, means coupled to the leaves for continuously imposing on the leaves a bias tending to fold the leaves toward each other, means coupled to the leaves for releasably retaining such rotatable leaves angularly spaced from each other against said bias in said operating condition, and means for providing an emergency exit through said openings, including means for releasing the angularly spaced leaves in response to an emergency condition to release said bias to fold the leaves toward each other.

From another aspect thereof, the subject invention resides in apparatus for providing an exit for people through a building wall, comprising, in combination, a revolving door having a first leaf, a second leaf and a third leaf suspended, respectively, with respect to first, second and third leaf carrier arms and rotatable with the leaf carrier arms in an enclosure having opposed inside and outside openings relative to the building wall, means for connecting the first leaf to the first leaf carrier arm for rotation therewith, first selectively releasable means for releasably connecting the second leaf to the second leaf carrier arm for rotation therewith, second selectively releasable means for releasably connecting the third leaf to the third leaf carrier arm for rotation therewith, means for automatically moving the second and third leaves into alignment with the first leaf upon release of the first and second selectively releasable means, including means for storing energy and means for selectively releasing the stored energy to the second leaf relative to the second leaf carrier arm and for selectively releasing the stored energy to the third leaf relative to the third leaf carrier arm, and means connected to the first and second selectively releasable means for selectively releasing the first and second releasable means.

Other aspects of the invention will become apparent in the course of this disclosure, and no restriction to any system, method, apparatus, combination, step, element or feature is intended by the subject summary of the invention.

BRIEF DESCRIPTION OF THE DRAWINGS

The subject invention wi11 become more readi1y apparent from the following detailed description of preferred embodiments thereof, illustrated by way of example in the accompanying drawings, in which like reference numerals designate like or functionally equivalent parts, and in which.

DESCRIPTION OF PREFERRED EMBODIMENTS

Figure 1:
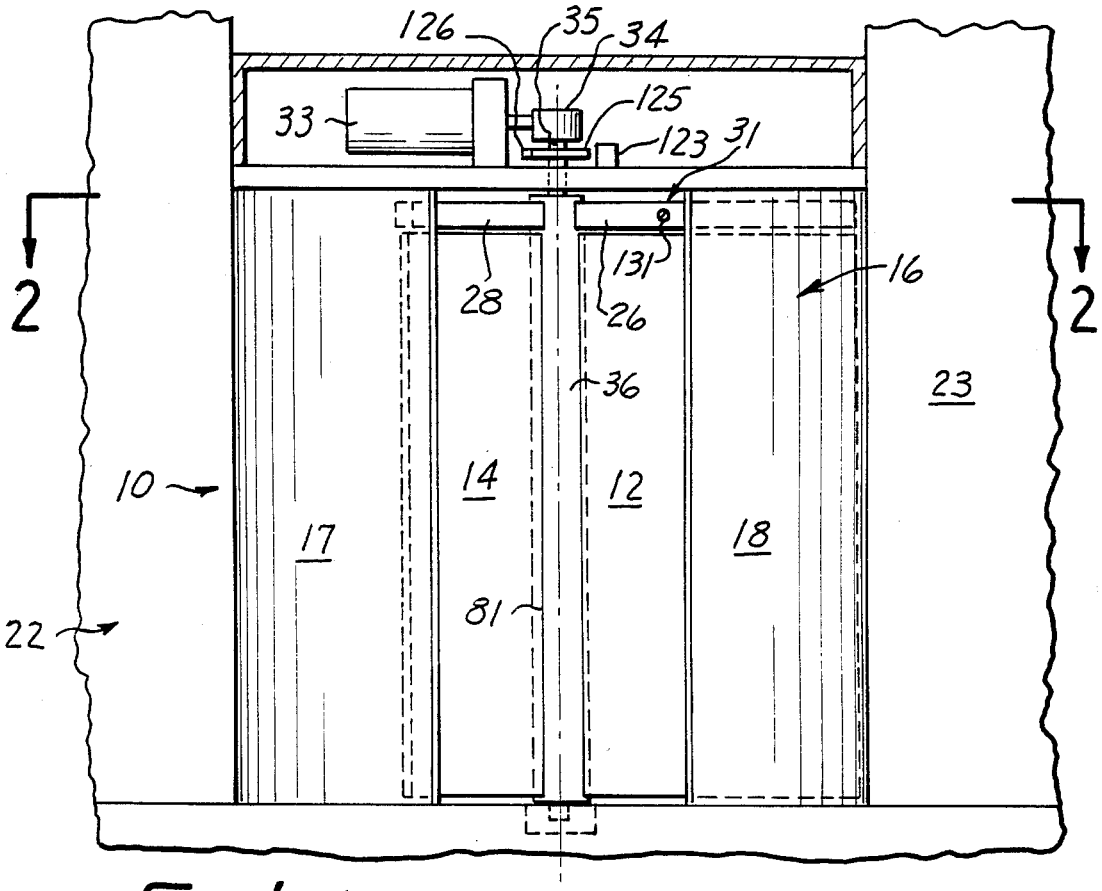
FIG. 1 is an elevation, partially in section, of a revolving door structure incorporating a preferred embodiment of the subject invention.
Figure 2:
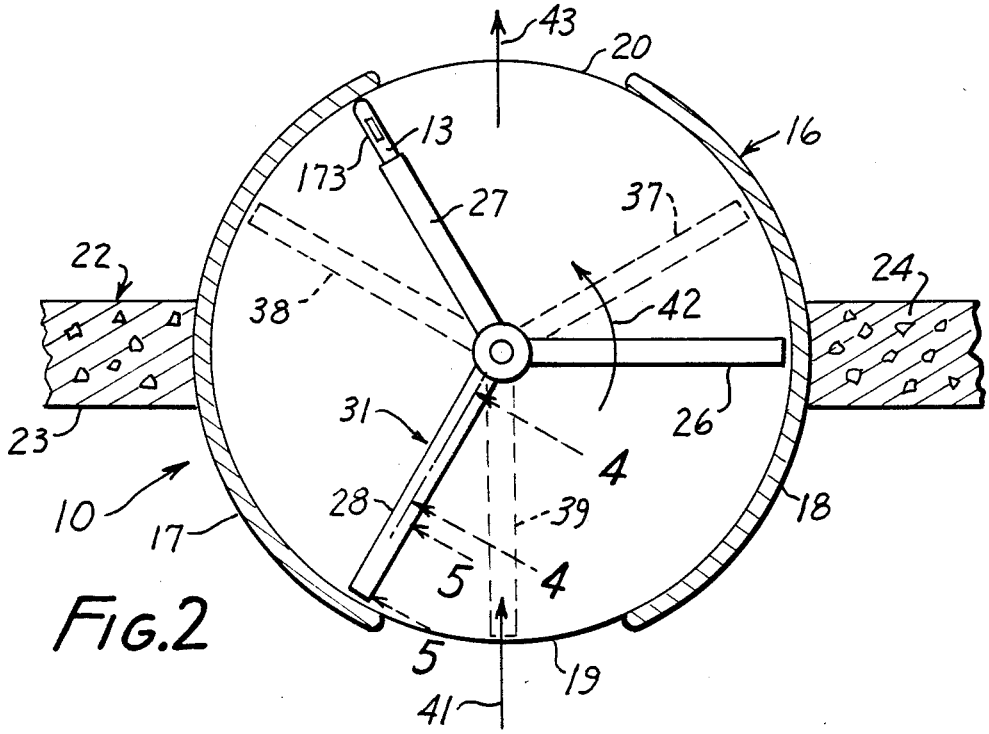
FIG. 2 is a section taken on the line 2—2 in FIG. 1.
Figure 3:
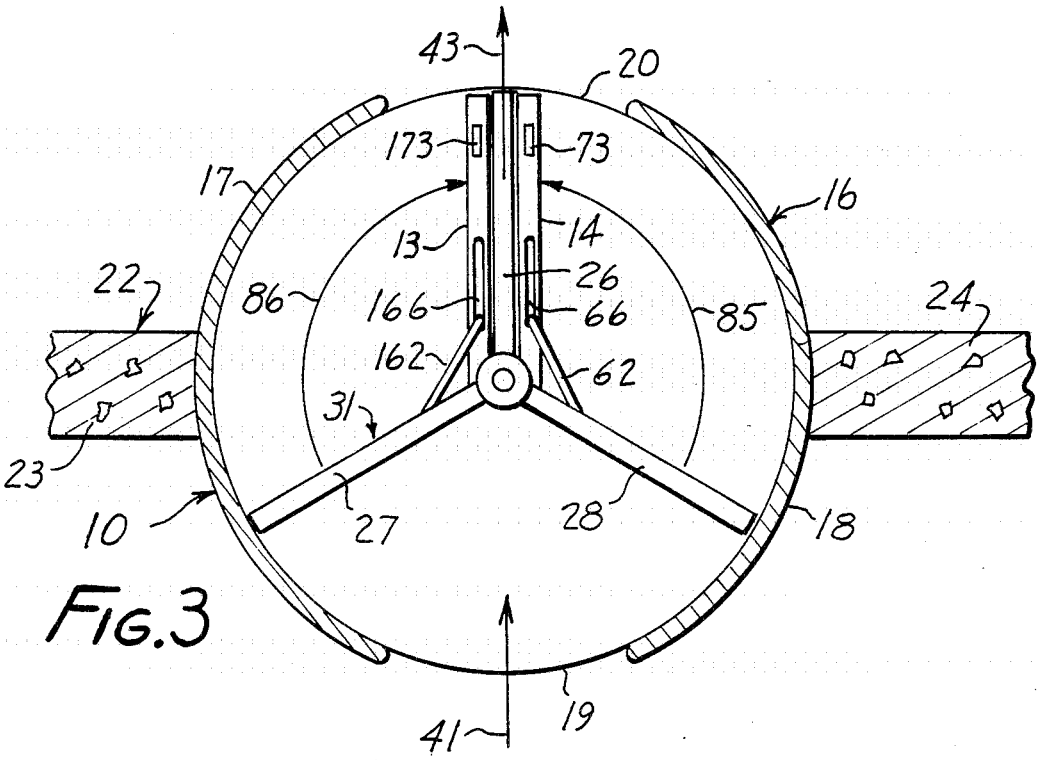
FIG. 3 is a view similar to FIG. 2, showing the revolving door structure in an automatically effected emergency exit mode, according to an embodiment of the subject invention.
Figure 4:
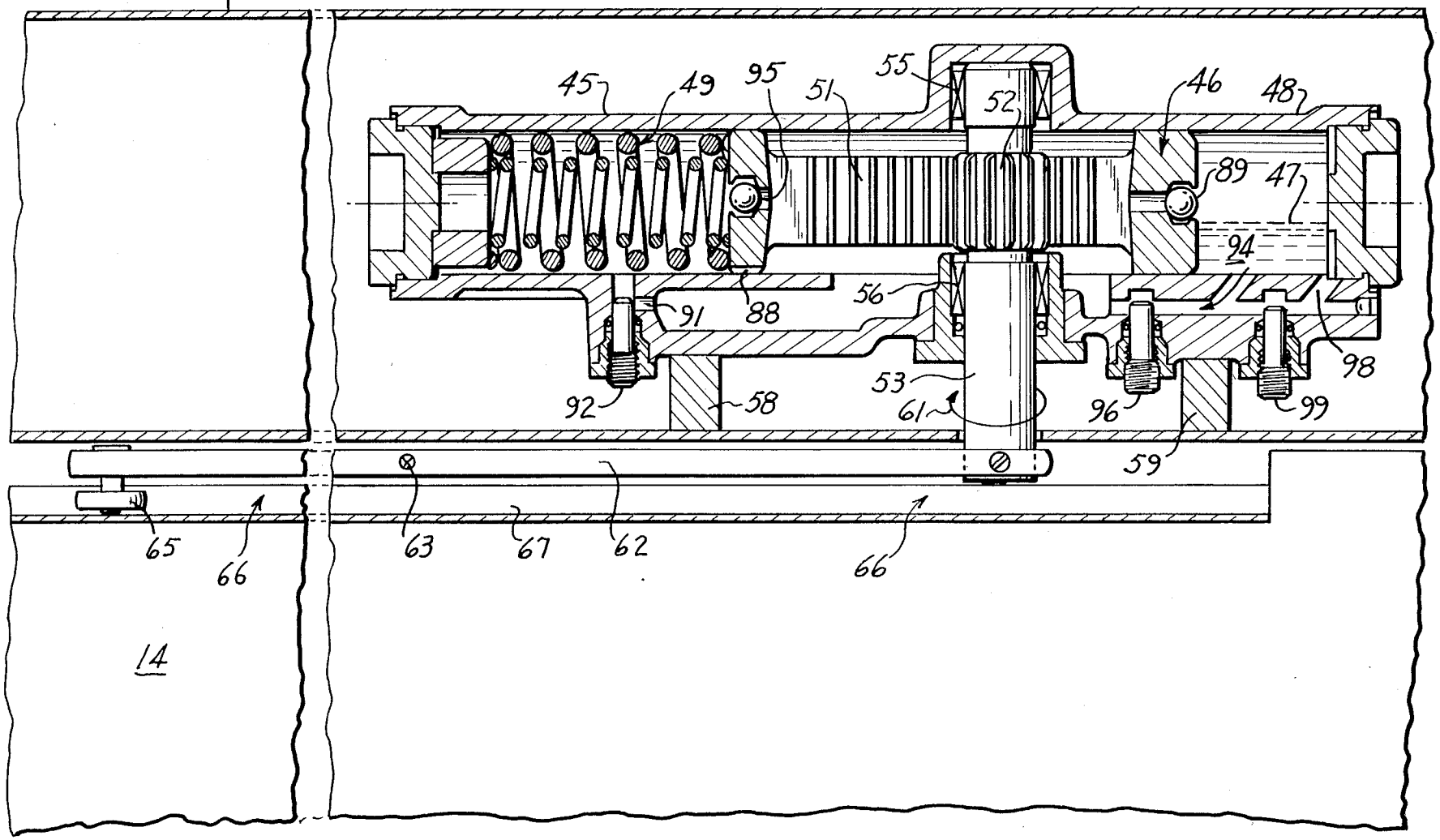
FIG. 4 is a partial section taken on the line 4—4 in FIG. 2.

The revolving door structure 10 shown in FIGS. 1, 2 and 4 has revolving door leaves 12, 13 and 14 angulary spaced from each other in an operating condition as shown in FIGS. 1 and 2. The angularly spaced leaves 12 to 14 are rotatable in a revolving door enclosure or drum 16 having enclosure wall sections 17 and 18 defining opposed inside and outside openings 19 and 20 relative to a building wall 22. In practice, that wall may include wall sections 23 and 24 of a building equipped with the revolving door structure 10. A ceiling normally present in buildings at the ground and upper floors has, however, not been shown in the drawings, since it may be of a conventional type. In the embodiment shown in FIGS. 1, 2 and 3, the revolving door has a first leaf 12, a second leaf 13 and a third leaf 14 suspended, respectively, with respect to first, second and third leaf carrier arms 26, 27 and 28 of a turnstyle-like structure 31. These first, second and third leaves 12 to 14 are rotatable with the leaf carrier arms 26 to 28 in the enclosure 16 having the opposed inside and outside openings 19 and 20 relative to the building wall 22.

For the convenience of its users, the revolving door structure 10 is equipped with an electric motor 33 for rotating the angularly spaced door leaves via a gearbox 34, shaft 35, boom 36 and leaf carrier arms 26 to 28. The door leaves may thus be rotated continuously, continually or whenever any person desires to enter or exit through the revolving door structure 10.

On the other hand, it should be clearly understood that the subject invention and most of its embodiments are not limited to use with motor-driven revolving door structures. Rather, the utility of the subject invention extends to manually operated revolving doors as well.

As indicated by dotted outlines 37, 38 and 39 in FIG. 2, the leaf carrier arms 26, 27 and 28, respectively, and thereby the door leaves 12, 13 and 14 maintained in coincidence therewith, rotate at their mutual angular relationship within the door enclosure 16. People may thus pass, for instance, through the revolving door structure from the inside opening 19 to the outside opening 20 as broadly indicated by arrows 41, 42 and 43 in FIG. 2. The door leaf structure may thereby be rotated in the direction of arrow 42, either by the people themselves pushing against one of the door leaves at a time, or by the motor 33 rotating the door leaf structure via gearbok 34.

The subject invention, from one aspect thereof continuously imposes on the door leaves 12 to 14 a bias tending to fold such leaves toward each other. The continuous nature of such bias imposition is distinguished from the transient force or bias imposed on any door leaf by a person pushing himself or herself through the door structure, or even from the force applied by persons trying to break one or more door leaves loose in a panic situation for rapid emergency exit.

A preferred means and method for imposing the requisite bias according to an embodiment of the subject invention is shown in FIG. 4, with the aid of a foreshortened partial showing of the leaf carrier arm 28 and associated revolving door leaf 14.

The door leaf bias imposing means 45 according to the illustrated preferred embodiment of the subject invention include, for each leaf to be folded from an angularly spaced position, a piston 46 coupled to the latter leaf, such as to the leaf 14, for displacing a fluid 47 in a cylinder 48 upon movement of the latter leaf from its angularly spaced position. The bias imposer 45 also includes a spring 49 acting on the piston 46 for imposing the bias on the latter leaf 14. In the illustrated embodiment, the spring force is actually provided by a pair of concentric helical springs, which may be dimensioned in a conventional manner to provide any desired spring bias characteristic.

In the illustrated embodiment, forces between the bias imposer 45 and the door leaf 14 are transmitting via a rack and pinion arrangement. By way of example, the piston 46 may include a square rack 51 meshing with a pinion 52 located on a shaft 53. That shaft is journaled in needle bearings 55 and 56. The cylinder unit 48 is maintained relatively stationary in the hollow leaf carrier 28 on mounting blocks 58 and 59 or other fastening means.

The spring bias developed at 49 biases the shaft for rotation in the direction of arrow 61. That torque, in turn, biases an arm 62 away from the observer, as indicated by an arrow symbol 63 in FIG. 4. The arm 62 has a roller 65 journaled at a free end thereof. The roller 65 rides in a track 66 mounted on top of the door leaf 14. The two opposite sides of that track, one of which is seen at 67 in FIG. 4, may be concave so as to accommodate of convex circumference of the roller 65, thereby keeping such roller inside the track 66.

Because of the continuously present torque 61, the arm 62 would push the door leaf 14 away from its angular position below the corresponding leaf carrier 28. However, in the normal operation of the revolving door, the leaf 14 and any other door leaf equipped with a bias imposer, is restrained from so moving from its normal angular position in coincidence with its leaf carrier.

Figure 5:
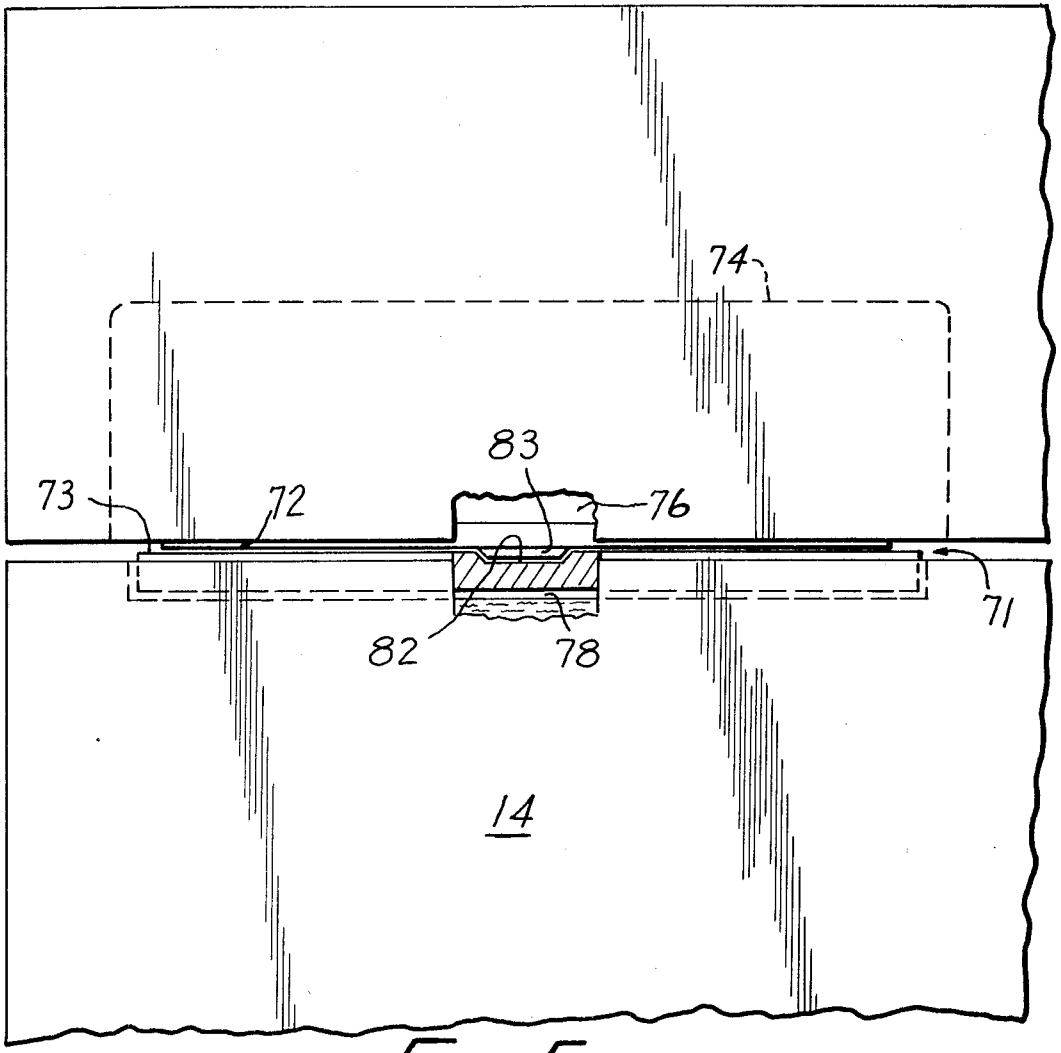
FIG. 5 is a partial section taken on the line 5—5 in FIG. 2.

In particular, the subject invention releasably retains the rotatable leaves 12 to 14 angularly spaced from each other against the bias 49, 61, 63 in the operating condition of the revolving door structure. Most advantageously, magnetic locks or similar actuable and readily releasable door leaf retention means may be employed for this purpose. By way of example, FIG. 5 illustrates parts of a magnetic lock structure 71 having mutually attractable and selectively releasable first and second parts 72 and 73 connected, respectively, to a leaf carrier arm 28 and its corresponding door leaf 14. In the embodiment shown in FIG. 5, the first part 72 may be a pole piece of a magnetic lock having a winding 76 for selectively magnetizing the pole piece or armature 72. That armature is mounted at and partially in the carrier arm 28.

The mentioned second part 73 may, for instance, be a striker plate for the magnetic lock 74, being loosely retained in a cavity 78 at the top of the door leaf 14, for attraction by the pole piece or armature 72.

Figure 9:
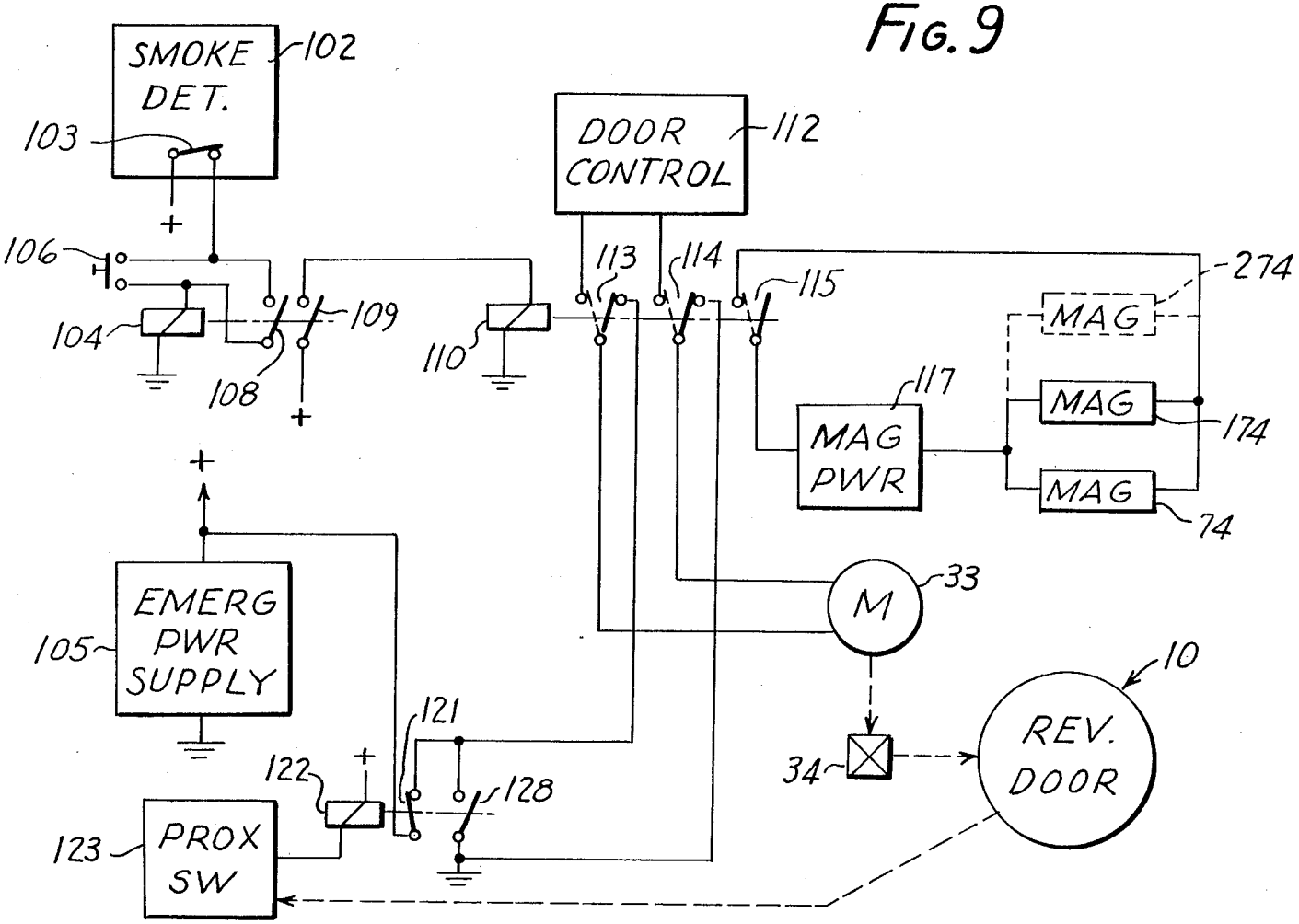
FIG. 9 is a schematic diagram of control circuitry for operating revolving door structures of the type herein disclosed according to embodiments of the subject invention.

As long as the armature winding 76 is electrically energized, the striker plate 73 is attracted by the armature as shown in FIG. 5. This releasably retains the door leaf 14 against the bias 49 etc. in coincidence with its corresponding carrier arm 28. As may be seen in FIGS. 2 and 3, the door leaf 13 is equipped with a striker plate 173 similar to the striker plate 73. Accordingly, as indicated in FIG. 9, there is a magnetic lock 74 for the carrier arm 28 and leaf 14 and a magnetic lock 174 for the carrier arm 27 and leaf 13. There also may be a third magnetic lock 274 for the carrier arm 26 and corresponding leaf 12. However, the first leaf 12 may be permanently mounted on its carrier arm 26, if the other leaves 13 and 14 are releasable from their carrier arms 27 and 28, respectively.

In this respect, the arm 26 may be a carrier arm in the sense of carrying the first leaf 12 attached thereto and suspended therefrom. The carrier arms 27 and 28, on the other hand, are carrier arms in the sense of carrying along the leaves 13 and 14, as long as the magnetic locks 74 and 174 are energized and the boom 36 is rotated, such as by the motor 33 or by a person pushing one of the leaves, such as the first leaf 12. However, the carrier arms 27 and 28 do not as such carry the leaves 13 and 14 against the weight of gravity. Rather, the leaves 13 and 14 are mounted on the vertical boom 36 by hinges, one of which is visible at 81 in FIG. 1. These hinges permit each leaf 13 and 14 to be angularly moved away from its normal position under the corresponding carrier arm 27 or 28.

However, as long as the magnetic locks 74 and 174 are energized, the leaves 13 and 14 are angularly movable together with their corresponding carrier arms 27 and 28 and in constant angular relationship with the first leaf 12 and carrier arm 26.

Since even strong magnetic locks are vulnerable to forced release by shearing action between their armature and striker plate, it is possible in practice that normal causes, such as the air pressure differential between the inside and outside of an air conditioned building, or ordinary handling of the revolving door, could break the leaves 13 and 14 away from their desired angular position, even if the magnetic locks 74 and 174 are energized in the absence of any emergency condition.

Fortunately, such unintended and undesired releases may effectively be prevented by employing an invention by William C. McFadden, described and claimed in his copending patent application Ser. No. 06/315,686, filed Oct. 27, 1981, for magnetic shear locking methods and apparatus, assigned to the common assignee and hereby incorporated by reference herein. According that invention, the striker plate has a cavity 82 for receiving a corresponding protrusion 83 of the armature or pole piece 72. This renders the magnetic lock 74 practically immune to shearing forces, including those imposed by pressure against the door leaf 14. Most advantageously, if the protrusion 83 has a slanted side, shearing motion between the magnetic lock parts 72 and 73 is translated into a lifting force, tending to lift either part away from the other. In other words, the slanted protrusion 83 translates shearing motion into a force that can be very well handled by the magnetic attraction of the armature 72 on the striker plate 73.

Accordingly, the magnetic locks 74 and 174 are not broken by regular use of the revolving door or by other normal causes. Even the strong bias exerted on the door leaves by such means as the springs in the bias imposer 45, is not capable of breaking the magnetic door leaf retention of the locks 74 and 174.

On the other hand, as soon as the magnetic locks have been deenergized in response to an emergency condition, the strong bias of the springs 49 swings the door leaf 14 away from its angular position under the carrier arm 28. Since the carrier arm 27 is also equipped with a bias imposer of the type shown at 45 in FIG. 4, release of the magnetic lock 174 also permits the particular spring bias to swing the door leaf 13 away from its angular position under the carrier arm 27. The extended door leaf actuator arms 62 and 162 of the bias imposer 45 located in the carrier arm 28 and of its counterpart located in the carrier arm 27 are seen in FIG. 3, as is the track 66 on top of the door leaf 14, in which the roller 65 shown in FIG. 4 rides when the spring-biased actuator arms 62 swings the door leaf 14 to its extended position in the direction of an arrow 85 in response to an emergency condition. Similarly, a track 166, corresponding to the track 66, but being located on top of the door leaf 13, is seen in FIG. 3 and accommodates in practice a roller of the type shown at 65 in FIG. 4, but journaled on and depending from a free end of the arm 162 for swinging the door leaf 13 to its extended position in the direction of the arrow 86 shown in FIG. 3.

The illustrated preferred embodiment of the invention includes methods and means for imposing adjustable sweep speeds on the released leaves 13 and 14. For instance, the illustrated preferred embodiment imposes on the latter leaves an adjustable sweep speed during their folding into line with the one leaf 12.

In practice, such imposition of an adjustable sweep speed permits those responsible for the safety of exiting people to adjust the sweep speed of the released door leaves 13 and 14 to a speed that will do no injury to people located in the revolving door at the time of an emergency. To this end, the preferred illustrated bias imposer 45, includes means for controllably impeding the displacement of the fluid 47 in the cylinder 48, for imposing an adjustable sweep speed on the leaf 14 upon a release thereof from the magnetic armature 72.

It should be understood in this respect that FIG. 4, for the sake of clarity, shows only part of the fluid 47 which, in practice, permeates the cylinder structure 48 or bias imposer 45. Also, while a hydraulic fluid, such as oil, is presently preferred, the utility of the illustrated embodiment extends to pneumatic actuators.

When the folded or released leaves are originally restored to their angular spaced positions, such as after an emergency, the piston 46 moves to the left as seen in FIG. 4 and hydraulic fluid is displaced to the right via an orifice-like lateral notch 88 in part of the piston structure.

Hydraulic fluid may further travel through a check valve 89 at another end of the piston structure. Displacement of the hydraulic fluid may be adjustably controlled by variation of an orifice 91 defined with the aid of an adjustable screw 92.

As released door leaves 13 and 14 are moved against the direction of the arrows 85 and 86 into alignment with their carrier arms 27 and 28, the bias springs 49 are compressed by the mentioned movement of the piston 46 to the left as seen in FIG. 4. The compressed coil spring 49 thus continuously impose on the restored leaves 13 and 14 a bias tending to fold such leaves toward each other, as seen in FIG. 3. However, energization of the magnetic locks 74 and 174 prevents the compressed coil springs 49 and their bias from moving the door leaves 13 and 14 at that time.

However, when the magnetic hold on the striker plate 73 and 173 is released or broken, the bias exerted by the compressed springs 49 is liberated to move the door leaves 13 and 14 via torque 61, arms 62 and 162, and tracks 66 and 166 in the direction of the arrows 85 and 86 shown in FIG. 3.

The compressed coil springs 49 thus are free to move the piston 46 to the right as seen in FIG. 4, whereby hydraulic fluid can flow through a passage 94 and also through a check valve 95 in the piston structure. The passage 94 is adjustable by rotation of a screw 96, forming an adjustable valve regulating the rate of hydraulic fluid flow. The sweep speed of the released door leaves 13 and 14 may thus be predetermined and adjusted to a safe value by appropriate adjustment of the hydraulic fluid valve or adjustment screw 96.

Damage to people and property, including the door leaves themselves, may thus conveniently be prevented according to the illustrated preferred embodiment of the subject invention.

As a further very important safety feature, the subject invention enables the disclosed door leaf bias to be overridden by people exiting the enclosure 16 or the building in an emergency. This is particulary important in case of revolving doors that may continue to rotate after release of the magnetic locks 74 and 174 or of similar door leaf constraints. In that case, an otherwise useful programmed or predetermined door rotation routine could in effect trap people in the revolving door or otherwise impede their desired or necessary progress therethrough. To prevent such injurious occurrences, the illustrated preferred embodiment of the subject invention enables the spring bias to be overridden in either direction by people anxious to pass through the enclosure 16 either way in an emergency. In this respect, it is possible that a person in the enclosure needs to exit or pass in a direction opposite to either of the arrows 85 and 86, while the disclosed spring bias tends to move either released leaf 13 or 14 in the direction of one of such arrows. With the illustrated preferred embodiment of the subject invention this, however, does not cause any problem or danger to the particular person. Rather, a person pushing, for instance, on the leaf 14 from one side may simply recompress the coiled springs 49 even after they have moved the door leaf 14 in an opposite direction for some distance.

Also, since the springs 49 are not completely compressed in the aligned and retained position of the door leaves, it is even possible for persons to move such leaves upon their release in a direction opposite to those of the arrows 85 and 86 beyond the corresponding carrier arms 27 and 28. Conversely, exiting persons may move the released door leaves 13 and 14 at a velocity greater than the predetermined sweep speed adjusted at 96 as the disclosed actuator 45 will accommodate to some extent such forced increase of the normal sweep speed. The important point thus is that once the magentic locks are released, there is no impediment to the exiting of people in the most reasonable and appropriate manner. An additional fluid flow passage 98 and valve 99 enable further control or fine adjustment of the door leaf sweep speed or overriding manipulation.

Those skilled in the art of door control will recognize that the biasing and sweep speed control features herein disclosed partake of many of the characteristics of hydraulic or pneumatic door closures. In fact, an appropriately modified, adjusted and preset commercial door closure arrangement may be employed at 45 in FIG. 4, even though its manner of operation and function according to the subject invention are, of course, different from conventional door closures and are as disclosed herein, rather than as customary in door closure installations.

Three-leaf door structures are presently believed to represent the most desirable arrangement, inasmuch as such structures have previously been disclosed as being particularly suitable for accommodating people in wheel chairs. However, the subject invention is not so limited. For instance, as shown in FIGS. 6 to 8, the subject invention may, for instance, be successfully applied to four-leaf revolving door structures.

Figure 6:
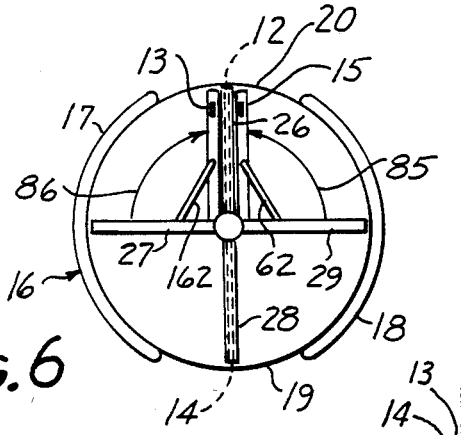
FIGS. 6 to 8 are views similar to FIG. 3 on a reduced scale, illustrating folding patterns of four-leaf revolving doors, according to embodiments of the subject invention.
Figure 7:
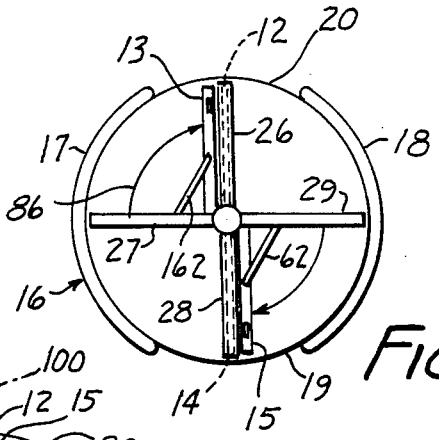
Figure 8:
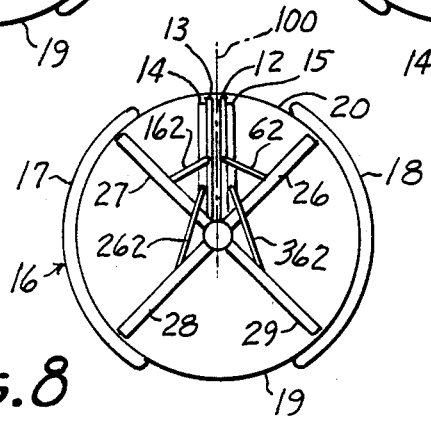

In this respect, FIGS. 6 to 8 show a fourth releasable door leaf 15 with its associated carrier arm 29. For a four-leaf door, the carrier arms 26 to 29 and thereby the releasably retained door leaves 13 to 15, are typically arranged in rectangular positions, as shown for the carrier arms 26 to 29 in FIGS. 6 to 8.

Moreover, FIGS. 6 and 7 show the spring-biased actuator arms 62 and 162 already shown and disclosed in connection with FIG. 3 as moving their associated door leaves upon a release thereof. Bias imposer and sweep speed control means of the type shown at 45 in FIG. 4 may be employed for moving the actuator arms 62 and 162 and their associated released door leaves 13 and 15 in the direction of arrows 85 and 86 in response to a sensed emergency.

According to FIG. 6, the third leaf 14 is retained in alignment with its carrier arm 28, as is the first leaf 12 with its carrier arm 26. This is also the case in FIG. 7, where the bias imposer in the fourth carrier arm 29 is, however, oriented so that its actuator arm 62 moves the released fourth leaf 15 into alignment with the stationary third leaf 14, rather than in alignment with the first leaf 12, as was the case in the arrangement of FIG. 6.

A further variation is apparent from FIG. 8 where door leaf actuator arms 62, 162, 262 and 362, biased and angularly moved by actuators of the type shown at 45 in FIG. 4, move the door leaves 12, 13, 14 and 15, respectively, into alignment with a midposition 100 between two of the actuator arms 26 and 27. It should be recognized in this respect, that not only the reduced FIG. 8, but also the remaining FIGS. 2, 3, 6 and 7, show the door leaves in a typically disproportionate thickness, representing in their folded condition a greater obstruction of the exit opening than is the case in an actual revolving door installation according to the subject invention and its preferred embodiments.

Also, while the drawings show one or more of the door leaves as being stationary relative to their carrier arms, this does not derogate from the broad statement that the subject invention continuously imposes on the door leaves a bias tending to fold such leaves toward each other. For one thing, since, for instance, the bias imposer 45 shown in FIG. 4 is mounted in one of the leave carrier arms 28, its spring bias developed at 49 acts, of course, between the leaf 14 and other carrier arms and leaves. Also, the expression "each other" in the mentioned statement has the dictionary definition of "each of two or more in reciprocal action or relation." The mentioned statement and expression are thus intended to be broad enough to accommodate not only the case, such as shown in FIG. 8, wherein all the leaves are biased and are swept upon a release thereof, but also the case, such as shown in FIGS. 3 and 6, where less than all of the leaves are biased and are swept into alignment with one of the leaves or, as shown in FIG. 7, even with alternate ones of two leaves 12 and 14.

In all these cases, the mentioned bias is employed to fold the released leaves toward each other. The latter statement thus accommodates such wide varieties as the embodiment of FIG. 8, where all the leaves 13 to 15 are biased and folded toward each other, as well as the embodiment of FIGS. 1 to 3, where two of the leaves 13 and 14 are folded toward one of the leaves 12. Such broad language also covers, for instance, the embodiment of FIG. 6, where two of the leaves 13 and 15 are also folded toward one of the leaves 12, and the embodiment of FIG. 7, where one of the leaves 13 is folded toward the leave 12, while another leave 15 is folded toward the leave 14, with "folded" in these cases standing for or signifying "angularly moved."

In these and equivalent cases, the leaves 12 to 14, with or without leaf 15, are spaced angularly from each other, with the aid of rotatable leaf carrier arms 26 to 28, with or without carrier arm 29, and a bias is imposed between such leaves and leaf carrier arms. The leaves are subjected to releasable retention against such bias in coincidence with the leaf carrier arms. By way of example, magnetic locks 74, 174 and 274 may be employed for this purpose with respect to at least some of the leaves. Leaves thus retained are thereupon released from retention in response to an emergency condition, and the desired emergency exit is provided through the openings 19 and 20 by folding the released leaves relative to the leaf carrier arms with their imposed bias.

Most advantageously, the leaves are automatically aligned with the aid of the disclosed bias parallel to a line of exit traffic through the openings 19 and 20.

According to an embodiment of the subject invention, the door leaves are automatically aligned by rotating the angularly spaced leaves, sensing alignment of one of such rotating leaves, such as the leave 13, in parallel to a line of exit traffic through the openings 19 and 20 (e.g. arrow 43 in FIG. 3), and automatically folding with the disclosed bias non-aligned leaves, such as leaves 13 and 14 or 13 and 15, into line with that one leaf 12 in response to an emergency condition. In addition to covering FIGS. 3 to 6, the latter phrase also covers the embodiment of FIG. 7, where the released bias swings the door leaves 13 and 15 into line with the door leaf 12, with which the door leaf 14 is already in line.

It may be said in this respect that the leaves are automatically aligned by first biasing with the disclosed bias, toward one of the leaves, the leaves angularly spaced therefrom, but maintaining the latter leaves angularly spaced from that one leaf, such as the leaf 12, by releasable retention against the disclosed bias, and by thereafter releasing such retention in response to an emergency condition and folding the latter leaves automatically by force of their bias into line with the mentioned one leaf. It is noted in this respect that the leaf 14 is not angularly spaced from the leaf 12 in the embodiments of FIGS. 6 and 7.

An example of emergency exit providing means for automatically aligning revolving door leaves parallel to a line of exit traffic through the openings 19 and 20 will now be disclosed with the aid of FIG. 9.

In particular, FIG. 9 shows a smoke detector 102 as a means for sensing an emergency condition, such as caused by a fire in the building serviced by the revolving door structure 10. The smoke detector has a normally closed contact 103, which remains closed as long as no emergency condition or smoke is sensed thereby. Accordingly, a relay 104 is energized from a power supply 105 via the normally closed smoke detector contact 103 upon depression of a reset button 106. The relay 104 actuates a self-holding contact 108, whereby the relay 104 remains energized as long as the smoke detector contact 103 is not opened.

The thus normally energized relay 104 also closes a contact 109 which, in turn, energizes a relay 110 from the power supply 105. The thus normally energized relay 110 connects the revolving door drive motor 33 to a conventional door control 112 via contacts 113 and 114, being actuated to their positions indicated in dotted lines in FIG. 9. Also actuated by the relay 110 are magnetic locks 74, 174, 274, etc., or their armature windings upon closure of a further contact 115 of the relay 110.

In this respect, only two magnetic locks 74 and 174 are required for releasable retention of the door leaves 13 and 14 in the revolving door structure 10 of FIGS. 1 to 5, but it is, of course, readily possible to provide each door leaf with a magnetic locking and quick release facility 74, 174, 274, etc., where release of all door leaves in emergency situations is desired or mandated.

The embodiments of FIGS. 6 and 7 may also be operated with only two magnetic locks 74 and 174. However, one or more magnetic locks 274 may be employed in practice, such as in the case of the embodiment of FIG. 8, where four magnetic locks are required for releasably retaining the four door leaves 12 to 15.

In principle, the magnetic locks may be energized from the power supply 105. However, because of different voltage and current requirements, a distinct magnetic lock power source 117 may be employed. In that case, the closing relay contact 115 connects the magnetic locks to their own power source 117.

In contrast to customary magnetic lock installations, the power source 117 need not necessarily include any battery or other feature which would continue the energization of the magnetic locks after a failure of the public power supply. In this respect, if the magnetic power supply 117 is simply connected to the public power supply so as to fail therewith, the door leaves serviced thereby will be automatically released for rapid exit whenever the public power supply fails.

On the other hand, the power supply 105 preferably includes a float-charged or other emergency power supply, which continues to supply electric power even after failure of the public or other power supply.

As long as the public power supply is intact, the revolving drive door motor 33 is energized via the then closed relay contacts 113 and 114 from the door control 112. This may be a conventional door control, energized from the public power supply and including the usual safety and handicap switches and other motor control components now practically customary with motor-driven revolving door installations.

The conventional door control 112 causes the motor 33 to continuously or continually rotate the angularly spaced door leaves in the enclosure 16.

If the detector 102 senses an emergency condition, such as smoke from a fire in the case of a smoke detector, it opens its normally closed contact 103, thereby deenergizing the relay 104. This, in turn, causes opening of the self-holding contact 108, so that the relay 104 remains deenergized until its reset button 106 is manually depressed. Deenergization of relay 104 also opens the contact 109, thereby deenergizing the relay 110. The relay switches 113 to 115 thus revert to their solidly illustrated positions. This immediately deenergizes the magnetic locks 74, 174, etc., whereby the continuously biased door leaves are released from their leaf carrier arms. In the preferred embodiment shown in FIG. 9, people in or at the revolving door may thus right then move the released door leaves away from their normal angular position, thereby if necessary overriding the bias imposed by the compressed springs 49, as disclosed above, for their most advantageous and appropriate emergency exit under the circumstances.

When the relay contacts 113 and 114 revert to their solidly illustrated positions in response to an emergency condition, they also remove the motor 33 from the regular door control 112 and connect such revolving door drive motor to the power supply 105, which persists even after a failure of the public power supply. In particular, an energizing circuit for the motor 33 is now established from the power supply 105 via a normally closed contact 121 of a relay 122, the contact 113 in its solidly illustrated position, the motor 33, the contact 114 in its solidly illustrated position, and ground.

Even though the voltage supply by the emergency power supply 105 is lower than the standard voltage provided via the door control 112, the power of the emergency supply is sufficient to energize the motor 33 for a continued drive of the revolving door 10 via the gearbox 34, until a proximity switch 123 senses alignment of one of the door leaves, such as the first door leaf 12, with or parallel to a line of exit traffic through the openings 19 and 20. In this respect and as illustrated in FIG. 1, the shaft 35 of the rotating door structure may be equipped with a cam 125 having a radial projection 126 for actuating a switch of the type shown at 123 in FIGS. 1 and 9. The projection 126 preferably is magnetic, so that a proximity switch may be employed at 123. Of course, there are microswitches for sensing a radial projection via a plunger, and there are photoelectric and other means for sensing the phase of a rotating door structure or power-driven shaft thereof.

The proximity switch 123 or other angular position sensing means energizes the relay 122 when the leading leaf 12 or carrier arm 26 is in the position shown in FIGS. 3, 6 or 7, or, in terms of FIG. 8, when the leaf carrier arms 26 and 27 are in their angular position relative to a line 100 shown in FIG. 8.

Energization of the relay 122 will open its relay contact 121, thereby disconnecting the motor 33 from the power supply 105. At the same time, the relay 122 closes a normally open contact 128, which short-circuits the energy supply leads of the motor 33 via the contacts 113 and 114, being then still in their solidly illustrated position. Such closure of the normally open relay contact 128 has the purpose of dynamically braking the motor 33 and thereby the revolving door in its position shown in FIGS. 3 and 6 to 8.

In principle, it is within the scope of the subject invention to release the magnetic locks only upon a determination, such as by the proximity switch 123, that the door has been rotated to its aligned angular exit position in response to a sensed emergency condition. In that case, the magnetic locks would be energized from their power supply 117 via a normally closed contact of the relay 122.

However, the arrangment shown in FIG. 9, where the magnetic locks are deenergized as soon as an emergency condition has been sensed, is preferably preferred for its greater safety to people which may otherwise be or feel themselves temporarily entrapped in the revolving door structure.

Most advantageously, the magnetic locks 74, 174, etc. may be monitored as disclosed in U.S. Pat. No. 4,287,512, by C. Marlon Combs, issued Sept. 1, 1981, assigned to the common assignee hereof, and herewith incorporated by reference herein. In this manner, an indication may be supplied, as disclosed in that patent, if and when the door leaves have been restored to their respective angular positions and are securely retained in alignment with their respective carrier arms against the disclosed bias, as long as no emergency condition has been sensed.

As indicated in FIG. 1, bolts 131 or other means may be employed for connecting the first leaf 12 to the first leaf carrier arms 16 for rotation therewith. First selectively releasable means, such as the magnetic lock 74, are provided for releasably connecting the second leaf 13 to the second leaf carrier arms 27 for rotation therewith.

Second selectively releasable means, such as the magnetic lock 174, are employed for releasably connecting the third leaf 14 to the third leaf carrier arms 28 for rotation therewith. Means such as those shown at 45 in FIG. 4, are employed for automatically moving the second and third leaves 13 and 14 into alignment with the first leaf 12 upon release of the first and second selectively releasable means 74 and 174, and include means for storing energy and means for selectively releasing such stored energy to the second leaf relative to the second leaf carrier arm and for selectively releasing such stored energy to the third leaf relative to the third leaf carrier arms. As disclosed with respect to FIG. 4, the energy storing means may include compressible coil springs 49, and the stored energy releasing means may include the rack and pinion arrangement 51 and 52, the torque shaft 53 and the actuator arm 62 with roller 65 riding in door track 66.

Means, including, for instance, those shown at 102, 104, 110 and 115 in FIG. 9, may be connected to the first and second selectively releasable means or magnetic locks 74 and 174, for selectively releasing such first and second releasable means, thereby releasing, in turn, the second and third door leaves 13 and 14 for sweeping movement toward the first door leaf 12.

Preferably, the energy storing means for generating the required bias include a first spring 49 and first coupling means 51 to 53 and 62 for coupling the first spring between the leaf 14 and the leaf carrier arm 28 for causing the first spring to store energy upon movement of the leaf 14 to the leaf carrier arm 28.

The same kind of spring may be employed for biasing the other leaf 13 and the same kind of coupling means may be provided for coupling such further spring between the leaf 13 and its leaf carrier arm 27 for causing such further spring to store energy upon movement of the leaf 13 to the leaf carrier arm 27.

The mentioned stored energy releasing means may include the first-mentioned coupling means for moving upon release of the first releasable means the leaf 14 into alignment with the first leaf 12 with energy stored by the spring 49. Similarly, the second-mentioned coupling means may be employed for moving upon the release of the mentioned second releasable means the leaf 13 into alignment with the first leaf 12 with energy stored by the mentioned compression spring.

In principle, selectively releasable means other than magnetic locks may be employed for releasably retaining the biased door leaves until an emergency condition arises. However, the magnetic locks herein disclosed constitute the presently perceived best mode for carrying the invention into effect.

The subject extensive disclosure will render apparent or suggest to those skilled in the art various modifications and variations within the spirit and scope of the subject invention and equivalents thereof.

I claim:

1. A method for providing an emergency exit for people through a revolving door having leaves angularly spaced from each other in an operating condition and rotatable in an enclosure having opposed inside and outside openings relative to a building wall, comprising the steps of:

continuously imposing on said leaves a bias tending to fold said leaves toward each other;

releasably retaining said rotatable leaves angularly spaced from each other against said bias in said operating condition;

releasing said angularly spaced leaves in response to an emergency condition; and providing an emergency exit through said openings by employing said bias to fold said released leaves toward each other.

2. A method as claimed in claim 1, including the step of:

restoring said folded leaves to angularly spaced positions after an emergency.

3. A method as claimed in claim 1, including the step of:

enabling said bias to be overridden by people exiting said enclosure in an emergency.

4. A method as claimed in claim 1, including the step of:

enabling said bias to be overridden in either direction by people anxious to pass through said enclosure either way in an emergency.

5. A method as claimed in claim 1, including the step of:

imposing adjustable sweep speeds on said released leaves.

6. A method as claimed in claim 1, including the steps of:

spacing said leaves angularly from each other with the aid of rotatable leaf carrier arms;

imposing said bias between said leaves and leaf carrier arms;

subjecting said leaves to releasable retention against said bias in coincidence with said leaf carrier arms;

releasing said leaves from said retention in response to an emergency condition; and providing said emergency exit through said openings by folding said released leaves relative to said leaf carrier arms with said imposed bias.

7. A method as claimed in claim 1, wherein:

said leaves are automatically aligned with the aid of said bias parallel to a line of exit traffic through said openings.

8. A method as claimed in claim 1, wherein:

said leaves are automatically aligned by rotating said angularly spaced leaves, sensing alignment of one of said rotating leaves parallel to a line of exit traffic through said openings, and automatically folding with said bias non-aligned leaves into line with said one leaf in response to an emergency condition.

9. A method as claimed in claim 1, wherein:

said leaves are automatically aligned by first biasing with said bias, toward one of said leaves, the leaves angularly spaced therefrom, but maintaining the latter leaves angularly spaced from said one leaf by releasable retention against said bias, and by thereafter releasing said retention in response to an emergency condition and folding said latter leaves automatically by force of said bias into line with said one leaf.

10. Apparatus for providing an exit for people through a building wall, comprising in combination:

a revolving door having leaves angularly spaced from each other in an operating condition and rotatable in an enclosure having opposed inside and outside openings relative to said building wall;

means coupled to said leaves for continuously imposing on said leaves a bias tending to fold said leaves toward each other;

means coupled to said leaves for releasably retaining said rotatable leaves angularly spaced from each other against said bias in said operating condition; and means for providing an emergency exit through said openings, including means for releasing said angularly spaced leaves in response to an emergency condition to release said bias to fold said leaves toward each other.

11. Apparatus as claimed in claim 10, wherein:

said emergency exit providing means include means for automatically aligning said leaves parallel to a line of exit traffic through said openings.

12. Apparatus as claimed in claim 10, wherein:

said emergency exit providing means include means for automatically aligning one of said leaves parallel to a line of exit traffic through said openings;

said releasing means including means for releasing non-aligned leaves in response to an emergency condition; and said bias imposing means including means coupled to said other leaves for automatically folding said non-aligned leaves into line with said aligned leaf.

13. Apparatus as claimed in claim 10, wherein:

said emergency exit providing means include means coupled to said door for rotating said angularly spaced leaves, and means for sensing, in response to an emergency condition, alignment of one of said rotating leaves parallel to said line of exit traffic through said openings;

said releasing means including means for releasing non-aligned leaves in response to an emergency condition; and said bias imposing means including means coupled to said other leaves for automatically folding said non-aligned leaves into line with said aligned leaf.

14. Apparatus as claimed in claim 10, including:

means coupled to said leaves permitting said bias to be overridden by people exiting said enclosure in an emergency.

15. Apparatus as claimed in claim 10, including:

means for imposing adjustable sweep speeds on said released leaves.

16. Apparatus as claimed in claim 10, wherein:

said means for imposing a bias include means coupled to said leaves for biasing, toward one of said leaves, leaves angularly spaced therefrom; and said releasing means include means connected to said retaining means for releasing said angularly spaced leaves in response to an emergency condition whereby said biasing means fold the latter leaves automatically by force of said bias into line with said one leaf.

17. Apparatus as claimed in claim 16, including:

means for imposing on said latter leaves an adjustable sweep speed during said folding into line with said one leaf.

18. Apparatus as claimed in claim 10, wherein:

said bias imposing means include, for each leaf to be folded from an angularly spaced position, a piston coupled to the latter leaf for displacing a fluid in a cylinder upon movement of the latter leaf from said angularly spaced position and a spring acting on said piston for imposing said bias on the latter leaf.

19. Apparatus as claimed in claim 18, including:

means for controllably impeding said fluid displacement in said cylinder for imposing an adjustable sweep speed on the latter leaf upon a release thereof.

20. Apparatus for providing an exit for people through a building wall, comprising in combination:

a revolving door having a first leaf, a second leaf and a third leaf suspended, respectively, with respect to first, second and third leaf carrier arms and rotatable with said leaf carrier arms in an enclosure having opposed inside and outside openings relative to said building wall;

means for connecting said first leaf to said first leaf carrier arm for rotation therewith;

first selectively releasable means for releasably connecting said second leaf to said second leaf carrier arm for rotation therewith;

second selectively releasable means for releasably connecting said third leaf to said third leaf carrier arm for rotation therewith;

means for automatically moving said second and third leaves into alignment with said first leaf upon release of said first and second selectively releasable means, including means for storing energy and means for selectively releasing said stored energy to said second leaf relative to said second leaf carrier arm and for selectively releasing said stored energy to said third leaf relative to said third leaf carrier arm; and means connected to said first and second selectively releasable means for selectively releasing said first and second releasable means.

21. Apparatus as claimed in claim 20, wherein:

said first selectively releasable means include a first magnetic lock having mutually attractable and selectively releasable first and second parts connected, respectively, to said second leaf carrier arm and to said second leaf; and said second selectively releasable means include a second magnetic lock having mutually attractable and selectively releasable third and fourth parts connected, respectively, to said third leaf carrier and to said third leaf.

22. Apparatus as claimed in claim 20, wherein:

said means for storing energy include a first spring and first coupling means for coupling said first spring between said second leaf and said second leaf carrier arm for causing said first spring to store energy upon movement of said second leaf to said second leaf carrier arm, and a second spring and second coupling means for coupling said second spring between said third leaf and said third leaf carrier arm for causing said second spring to store energy upon movement of said third leaf to said third leaf carrier arm; and said stored energy releasing means include said first coupling means for moving upon release of said first releasable means said second leaf into alignment with said first leaf with energy stored by said first spring, and said second coupling means for moving upon release of said second releasable means said third leaf into alignment with said first leaf with energy stored by said first spring.

23. Apparatus as claimed in claim 22, wherein:

said first selectively releasable means include a first magnetic lock having mutually attractable and selectively releasable first and second parts connected, respectively, to said second leaf carrier arm and to said second leaf; and said second selectively releasable means include a second magnetic lock having mutually attractable and selectively releasable third and fourth parts connected, respectively, to said third leaf carrier and to said third leaf.

24. Apparatus as claimed in claim 20, including:

means for sensing alignment of at least one of said first leaf and said first leaf carrier arm in parallel to a line of exit traffic through said inside and outside openings in response to an emergency condition; and means connected to said means for selectively releasing said first and second releasable means and to said sensing means for releasing said first and second parts and said third and fourth parts in response to said alignment sensing.

* * * * *